US006804876B1

(12) United States Patent
Ito et al.

(10) Patent No.: US 6,804,876 B1
(45) Date of Patent: Oct. 19, 2004

(54) METHOD OF PRODUCING CHIP INDUCTOR

(75) Inventors: Yoichiro Ito, Omihachiman (JP); Takahiro Yamamoto, Omihachiman (JP); Hiroshi Komatsu, Omihachiman (JP); Tadashi Morimoto, Hikone (JP)

(73) Assignee: Murata Manufacturing Co., LTD, Kyoto (JP)

( * ) Notice: Subject to any disclaimer, the term of this patent is extended or adjusted under 35 U.S.C. 154(b) by 258 days.

(21) Appl. No.: 09/583,369

(22) Filed: May 31, 2000

(30) Foreign Application Priority Data

May 31, 1999 (JP) ..... 11-151199
Mar. 30, 2000 (JP) ..... 2000-93104

(51) Int. Cl.[7] ..... H01F 7/06; H01F 41/06

(52) U.S. Cl. ..... 29/602.1; 29/605; 29/606; 29/608; 336/192; 336/223; 336/175; 336/206

(58) Field of Search ..... 29/608, 605, 606, 29/602.1, 607, 604, 883, 856; 336/192, 84 M, 83, 186, 65, 200, 206, 223, 175

(56) References Cited

U.S. PATENT DOCUMENTS 4,696,100 A 9/1987 Yamamoto et al.
5,551,146 A * 9/1996 Kawabata et al. ..... 29/608
5,690,771 A 11/1997 Kato et al. ..... 156/244.11
6,063,321 A * 5/2000 Koyama et al. ..... 264/404
6,076,253 A * 6/2000 Takayama et al. ..... 29/605
6,104,272 A * 8/2000 Yamamoto et al. ..... 336/83
6,311,387 B1 * 11/2001 Shikama et al. ..... 29/602.1
2002/0020052 A1 * 2/2002 Ito et al. ..... 29/606

FOREIGN PATENT DOCUMENTS

| | | |
|---|---|---|
| DE | 19925669 | * 12/1999 |
| JP | 58-089807 | 5/1983 |
| JP | 58-132907 | 8/1983 |
| JP | 4-088604 | 3/1992 |
| JP | 4-165605 | 6/1992 |
| JP | 2000-36429 | * 2/2000 |

* cited by examiner

*Primary Examiner*—Minh Trinh
(74) *Attorney, Agent, or Firm*—Keating & Bennett, LLP

(57) ABSTRACT

A method of producing a chip inductor including the steps of inserting a conductive wire made of a metallic wire into a metallic mold, supporting both end portions of the conductive wire on support portions provided on inner surfaces of the metallic mold so as to position the conductive wire in the approximate center portion of the metallic mold, casting magnetic ceramic slurry into the metallic mold, molding the ceramic slurry case in the metallic mold by wet pressing to obtain a molding body having the conductive wire embedded therein, firing the molding body, and forming external electrodes on both end surfaces of the fired magnetic core such that the external electrodes are connected to both end portions of the conductive wire.

6 Claims, 4 Drawing Sheets

METHOD OF PRODUCING CHIP INDUCTOR

BACKGROUND OF THE INVENTION

1. Field of the Invention

The present invention relates to a method of producing a chip inductor for use in a noise filter, a transducer, or other suitable apparatus.

2. Description of the Related Art

Chip inductors are widely used as high frequency filters for eliminating radiation-noises from digital equipment, such as computers. Japanese Unexamined Utility Model Publication No. 6-50312 illustrates one known monolithic chip inductor, in which a chip element body having laminated ceramic layers is provided. A coil conductor provided between the ceramic layers is connected via through-holes provided in the ceramic layers. A coil is provided in the chip element body, and the leading and trailing portions of the coil are connected to external electrodes, respectively.

An inductor for use in a high frequency filter is required to have a large inductance and a low resistance. In general, inductance is proportional to the square of the winding number of a coil and is inversely proportional to the length of the coil. A monolithic inductor of the above-described type is difficult and costly to produce due to its complexity. Moreover, a large inductance cannot be achieved because the winding number of the coil cannot be increased. Further, the resistance is relatively large because the coil conductor is constructed as a film-shape electrode.

To solve the problems described above, a method of molding an inductor is described in Japanese Unexamined Patent Application Publication No. 8-191022, in which a magnetic ceramic is extrusion-molded into a winding-core, a conductive wire is wound around the core into a coil-shape, and another magnetic ceramic is extrusion-molded thereon to form a sheathing body. Thereafter, the ceramics are fired, and external electrodes are arranged to cover both ends of the fired magnetic core, and thereafter, bonded to both ends of the fired magnetic core. Thus, the external electrodes are connected to both ends of the coil-shaped conductive wire. In this case, the production method is less complicated than with the monolithic inductor, and less costly because a metallic wire is used for the coil-shaped conductive wire. Additionally, an inductor made by the above-described method produces the desired high inductance and a low resistance.

In the above-described production methods, both portions of the magnetic ceramic that eventually become the winding-core and the sheathing body are formed by extrusion molding. The density of a molding product produced by extrusion molding is not sufficiently high. Further, in some cases, the sheathing body contains voids in the periphery of the coil and cavities are formed between the winding-core and the sheathing body. Moreover, a binder is needed to combine the ceramic particles to each other. This binder causes the formation of pores during firing. Therefore, it has been difficult to produce high-quality inductors using this method.

Furthermore, when the sheathing body is extrusion-molded, the coil is often formed eccentrically with respect to the center portion of the sheathing. Accordingly, an inductor having stable magnetic properties cannot be produced. Further, when firing is performed on eccentric coils, warpage or cracks may develop, due to the shrinkage of the ceramic when it is fired.

SUMMARY OF THE INVENTION

In order to overcome the problems described above, preferred embodiments of the present invention provide a method of producing a chip inductor that produces a high-quality inductor and greatly reduces warpage and cracks caused by firing-shrinkage.

According to a preferred embodiment of the present invention, a method of producing a chip inductor is provided which includes the steps of inserting a conductive wire made of a metallic wire into a metallic mold, supporting both the end portions of the conductive wire on supporting-portions provided on the inside of the metallic mold so as to position the conductive wire in the approximate center portion of the metallic mold, casting magnetic ceramic slurry into the metallic mold, molding the ceramic slurry cast in the metallic mold by wet pressing to obtain a molding body having the conductive wire embedded therein, firing the molding body, and providing external electrodes on both of the end surfaces of the fired magnetic core such that the external electrodes are connected to both the end portions of the conductive wire.

As described above, the conductive wire is inserted into the metallic mold, the magnetic slurry is cast, and thereafter, the wet pressing is carried out. With this method, both of the end-portions of the conductive wire are supported on the supporting-portions provided on the inside of the metallic mold so that the conductive wire is positioned in the approximate center portion of the metallic mold. Thereby, the conductive wire does not become eccentric during the wet pressing. The supporting portions are supporting-grooves provided on the inside of the metallic mold. The molding body having the conductive wire embedded therein is produced by the wet pressing method. The molding body produced by the wet pressing method has a tight ceramic structure and a higher density as compared with one produced by extrusion molding method. Further, since the ceramic slurry is compressed, the amount of binder required is greatly reduced, and in many instances no binder is required. Therefore, a high quality inductor is produced by firing the molding body because of the high density magnetic core produced by firing. Further, the generation of pores is greatly reduced due to the reduced amount of a binder required.

As described above, the conductive wire is inserted into the metallic mold, and the wet pressing is carried out. Thus, the inductor can be formed by one molding cycle. Therefore, the production process is greatly simplified as compared with the production process for the laminated inductor. This production process is also greatly simplified as compared with an extrusion molding method. In the case where the coil-shaped wire is used as the conductive wire, a high inductance can be obtained at a lower resistance as compared with the laminated inductor.

When the linear conductive wire is used, the inductance is low as compared with that obtained when the coil-shaped conductive wire is used, however, the direct current resistance is further reduced.

When the molding body produced by wet pressing as described above is fired, the ceramic material is shrunk via firing. In this case, although the ceramic shrinks, the conductive wire does not shrink, or shrinks substantially less than the ceramic. When the coil-shaped conductive wire is used, voids are formed inside the coil. A flux may flow into the voids from the outside, affecting the characteristics of the inductor. Further, in some cases, in addition to the formation of voids, cracks are formed within the coil due to the firing-shrinkage. Moreover, where the molding is used to obtain a plurality of the molding bodies in one cycle, such that a long coil-shaped conductive wire is used, the coil-shaped conductive wire may be deflected if only the end-portions of the coil-shaped conductive wire are supported on the supporting portions of the metallic mold as described above. If the molding is used in this state, the coil-shaped conductive wire may not be disposed precisely in the center of the core along its entire length.

Thus, according to another preferred embodiment of the present invention, the winding-core made of the fired magnetic ceramic is inserted into the coil-shaped conductive wire, before the coil-shaped conductive wire is inserted into the metallic mold. Since the winding-core arranged inside the coil-shaped conductive wire is not shrunk, no voids are formed inside the coil-shaped conductive wire by firing, and moreover, formation of cracks, caused by firing-shrinkage, is prevented. Further, the winding-core is inserted into the coil. Accordingly, even if the coil length increases, deflection of the coil is prevented by the winding-core. Thus, a high quality inductor is obtained as compared to conventional methods and inductors.

The winding-core may have the same or a different composition from that of the magnetic core provided outside the coil. If the winding-core has the same composition as the magnetic core provided outside the coil, a magnetic core which is homogeneous inside and outside its coil is obtained. If the compositions are different, the magnetic permeabilities inside and outside the coil can be varied. Thus, the characteristics of an inductor can be easily altered.

Other features, elements, characteristics and advantages of the present invention will become apparent from the following description of the present invention and the accompanying drawings.

DETAILED DESCRIPTION OF PREFERRED EMBODIMENTS

Figure 1:
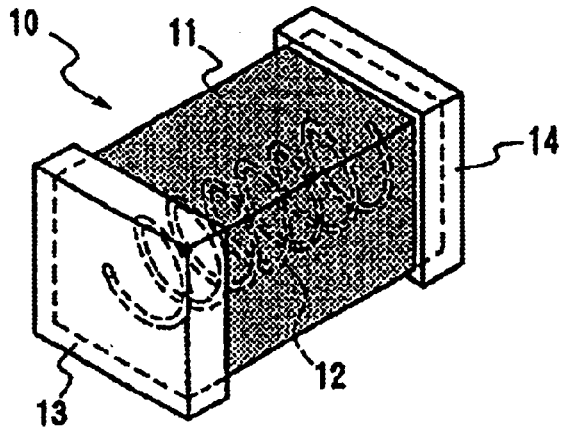
FIG. 1 is a perspective view of an inductor according to preferred embodiments of the present invention.
Figure 2:
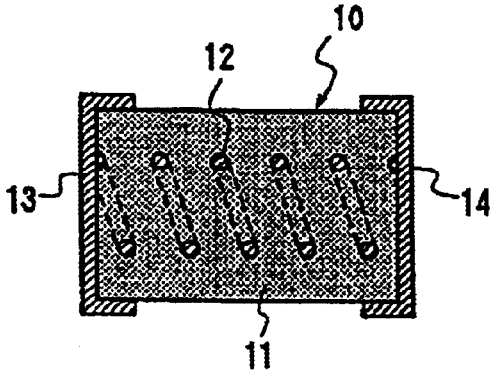
FIG. 2 is a cross-sectional view of the inductor of FIG. 1.

FIGS. 1 and 2 each show a chip inductor according to a first preferred embodiment of the present invention.

The inductor 10 is provided with a magnetic core 11 preferably having a substantially prism-shaped body. The core 11 is produced by firing a magnetic ceramic such as Ni—Cu—Zn based ferrites or other suitable ceramic. Regarding the shape of the core 11, different shapes and sizes, such as a column-shape, may be used, in addition to the prism-shape. A coil-shaped conductive wire 12 made of a metallic wire of Ag, Cu, or an alloy thereof and configured in a spiral-shape is embedded inside the core 11. Both ends of the coil-shaped conductive wire are exposed to end-surfaces of the magnetic core 11. On the exposed surfaces, external electrodes 13 and 14 made of thick-film electrodes are provided. Accordingly, the external electrodes 13 and 14 are electrically connected to both ends of the coil-shaped conductive wire 12, respectively.

A method of producing the chip inductor 10 having the above-described structure will be described in reference to FIGS. 4A to 4E.

Figure 3:
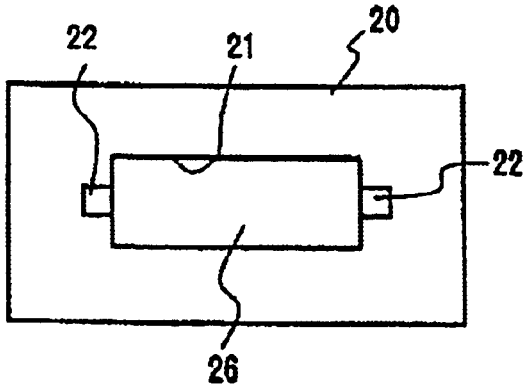
FIG. 3 is a plan view of an example of a metallic mold according to preferred embodiments of the present invention.
Figure 4A:
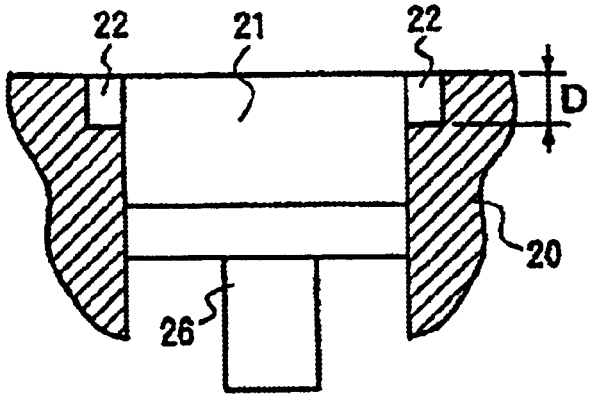
FIGS. 4A, 4B, 4C, 4D, and 4E are process drawings showing a method of producing an inductor according to a first preferred embodiment of the present invention.

First, a metallic mold 20 as shown in FIGS. 3 and 4A is prepared. A cavity 21 is provided by the metallic mold 20 and a lower die 26 described later. Supporting-grooves 22, which are supporting portions for supporting both ends of the coil-shaped conductive wire 12, are provided inside of opposite end portions of the cavity such that the cavities have a desired depth D from the upper end surfaces, respectively. The depth D is set so that the coil-shaped conductive wire 12 is positioned in the approximate center portion of a molding body 27 when wet press molding is performed. The above-described supporting-grooves 22 prevent the coil-shaped conductive wire 12 from becoming eccentric when ceramic slurry 23 is cast into the cavity 21 and dispose the coil-shaped conductive wire 12 in the center portion of the metallic mold 20. Further, the shape of the supporting-grooves 22 is not critical.

Figure 4B:
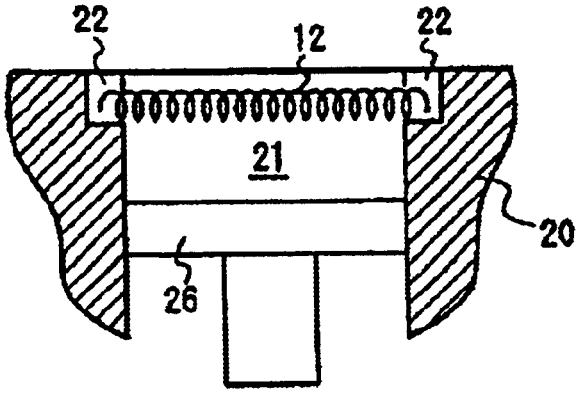

Next, the coil-shaped conductive wire 12 is inserted into the cavity 21 of the metallic mold 20, as shown in FIG. 4B, and both the ends of the coil-shaped conductive wire 12 are positioned on the supporting-grooves 22. The coil-shaped conductive wire 12 in this preferred embodiment is formed by winding an Ag wire with a wire diameter $\phi$ of approximately 200 $\mu$m into a spiral shape having an inner diameter of approximately 1.25 mm of the coil and a coil pitch of approximately 0.4 mm. The coil-shaped conductive wire 12 may have a length equivalent to the overall length of a plurality of inductors for molding using multi mold-cavities to obtain a plurality of the molding bodies.

Figure 4C:
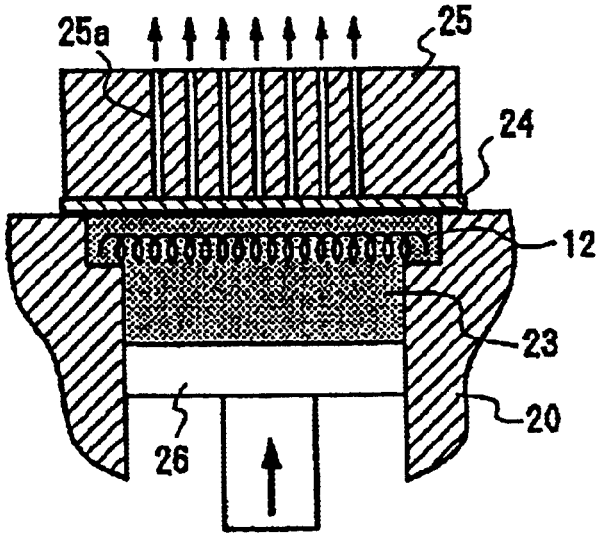
Figure 4D:
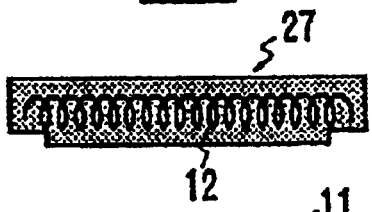

Next, the ceramic slurry 23 is cast into the cavity 21 as shown in FIG. 4C, and wet pressing is performed. Approximately 1500 g of raw material comprising a Ni—Cu—Zn based ferrite, approximately 650 g of refined water, approximately 0.2 wt. % on a basis of the raw material of an anti-foaming agent, and approximately 0.5 wt. % of a dispersant are added, placed into a pot mill, and mixed with PSZ balls for approximately 17 hours. The mixture is used as the ceramic slurry 23. After the ceramic slurry 23 is cast, the upper side of the cavity 21 is covered with a filter 24 through which only water can pass, and a porous upper die 25 is packed thereon. Then, press-forming is carried out. The lower die 26 is moved upwardly from the lower position in the metallic mold 20, as seen in FIG. 4C, such that a pressure of approximately 100 kgf/cm$^2$, or other suitable pressure, is applied to the ceramic slurry 23 for approximately 5 minutes to extract water contained in the ceramic slurry through the filter 24 and the water-extracting holes 25*a* of the upper die 25. The molding body 27 formed as described above, as seen in FIG. 4D, has a high density, since the ceramic slurry 23 is pressed, and the ceramic slurry 23 is filled into the periphery of the coil-shaped conductive wire 12 without developing any voids.

Thereafter, the molding body 27 is removed from the metallic mold 20. The molding body 27 is dried, at approximately 40° C. for approximately 50 hours, and fired at approximately 910° C. for approximately 2 hours. In this case, the molding body 27 has a high density and a high filling-degree, since the molding body 27 is formed in a wet-press method. In addition, in the ceramic slurry 23, since it contains no binder, formation of pores is prevented, and a high quality sintered body is produced. Further, due to the supporting-grooves 22, the coil-shaped conductive wire 12 is prevented from becoming eccentric, and is positioned in the approximate center portion of the sintered body. Thus, an inductor having very stable characteristics is produced.

Figure 4E:
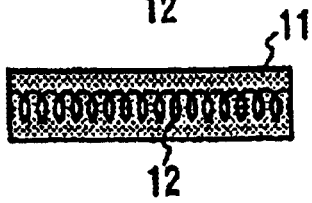

Thereafter, as shown in FIG. 4E, the extraneous portions at both ends of the sintering body (the portions corresponding to the supporting-grooves 22) are trimmed to a desired length to produce the magnetic core 11. Then, the external electrodes 13 and 14 are formed on both end-surfaces of the core 11 where the coil-shaped conductive wire 12 is exposed, and thereby the chip inductor 10 (see FIGS. 1 and 2) is produced. Regarding a method of forming the external electrodes 13 and 14, such as Ag paste, AgPd paste, or other suitable materials, is coated, dried at approximately 150° C. for approximately 15 minutes, and baked at approximately 800° C. for approximately 10 minutes. Ni—Sn plating may be carried out, if desired.

Figure 5A:
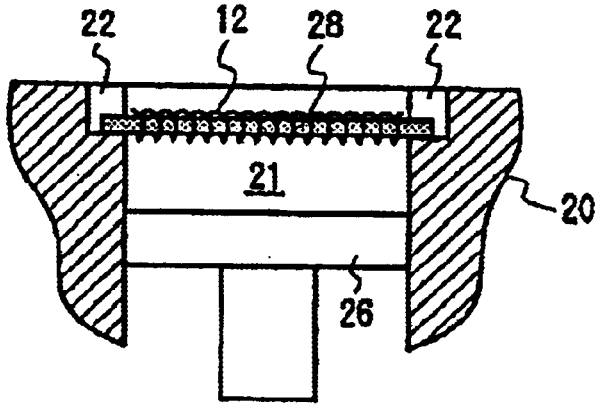
FIGS. 5A, 5B, and 5C are process drawings showing a method of producing an inductor according to a second preferred embodiment of the present invention.
Figure 5B:
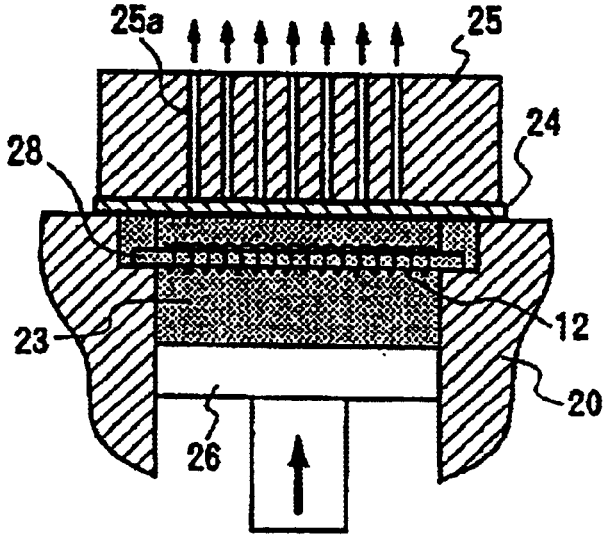
Figure 5C:
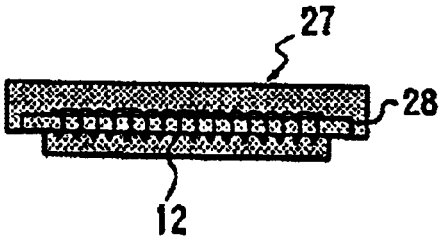

FIGS. 5A to 5C show a second preferred embodiment of the present invention.

In the above-described preferred embodiment, the coil-shaped conductive wire 12 is inserted directly into the metallic mold 20 as shown in FIG. 4B. However, when the ceramic material is shrunk at firing, cracks or voids may be formed in the ceramic portion within the coil-shaped conductive wire 12. Further, when a long coil-shaped conductive wire 12 is inserted for molding using multi-cavities to obtain a plurality of molding bodies, the coil-shaped conductive wire 12 may be deflected.

Accordingly, as shown in FIG. 5A, the coil-shaped conductive wire 12 is wound around a winding-core 28, and inserted into the metallic mold 20. The coil-shaped conductive wire 12 may be closely wound around the periphery of the winding-core 28, or the winding core 28 may be simply inserted into the coil-shaped wire 12. The winding-core 28 may be constructed of a ceramic material having the same as or a different composition from that of the magnetic core 11. However, a fired magnetic ceramic is preferably used. In this preferred embodiment, the axial length of the winding-core 28 is greater than the coil-shaped conductive wire 12, and both end-portions of the winding-core 28 are supported on the supporting-grooves 22 of the metallic mold 20.

Since the coil-shaped conductive wire 12 wound around the winding-core 28 is supported on the supporting-grooves 22 of the metallic mold 20, the coil-shaped conductive wire 12 is prevented from being deflected, due to the rigidity of the wound core 28, regardless of the length of the coil-shaped conductive wire 12. Further, when the ceramic slurry 23 is cast or wet-pressed as shown in FIG. 5B, the coil-shaped conductive wire 12 is prevented from deflecting upward.

The molding body 27, shown in FIG. 5C, is produced by the wet pressing. When the molding body 27 is fired, formation of cracks and voids inside the coil 12 is prevented, since the winding-core 28 does not shrink during firing. Upon firing, the ceramic slurry 23 and the winding-core 28 are integrated with each other to produce an integrally sintered body. Thereafter, as in the first preferred embodiment of the present invention, the sintered body is trimmed to a desired length to produce the magnetic core 11. The external electrodes 13 and 14 are provided on the core 11 to produce a chip inductor 10.

Figure 6:
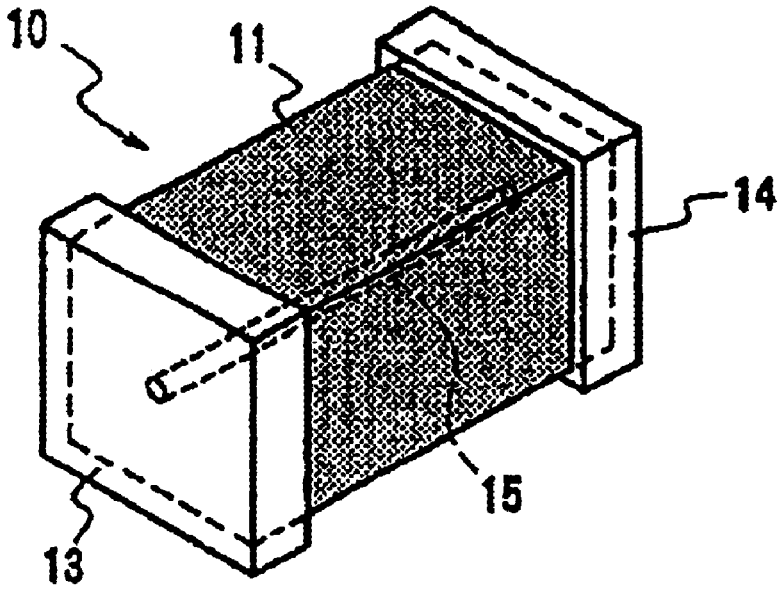
FIG. 6 is a perspective view of another inductor according to preferred embodiments of the present invention.

FIG. 6 shows a chip inductor according to a third preferred embodiment of the present invention.

In this preferred embodiment, a linear conductive wire 15 is provided in place of the coil-shaped conductive wire of the first and second preferred embodiments of the present invention. The remainder of this preferred embodiment is the same as that in the first preferred embodiment. Accordingly, the same reference numerals are used, and repetitive description is omitted.

Regarding the inductor using the linear conductive wire 15, the inductance is lower than the inductor using the coil-shaped conductive wire 12, however, the direct current resistance is reduced. Accordingly, the inductor is suitable for uses where the resistance must be as low as possible.

A method of producing an inductor having the linear conductive wire 15 is the same as that shown in FIGS. 4A to 4E, and the redundant description is omitted.

The structure of the supporting portions of the metallic mold 10 for supporting both end-portions of the conductive wire or the wiring core is not limited to the supporting-grooves 22 as described in the preferred embodiments. Any suitable shape and size may be used as long as both end-portions of the conductive wire or the winding-core are supported in a highly stable manner.

As seen in the above-description, according to preferred embodiments of the present invention, the molding body having the conductive wire embedded therein is obtained by a wet pressing method. Accordingly, the molding body has a higher density than products formed by extrusion-molding, and the amount of binder required is greatly reduced, and in many instances no binder is required. Thus, when the molding body is fired, a fired magnetic core having a high density is produced. Further, no pores are formed, since the amount of the binder is greatly reduced. Therefore, a high quality inductor is produced.

Further, both ends of the conductive wire are supported by the supporting portions provided in the metallic mold. Accordingly, the conductive wire is prevented from deflecting, and an inductor having stable characteristics is produced.

Further, according to preferred embodiments of the present invention, the coil-shaped conductive wire is wound on the outer periphery of the winding-core made of a fired magnetic ceramic, and the winding-core having the coil-shaped conductive wire wound therearound is set in the metallic mold, followed by molding by wet pressing. In addition to the advantages of the method of producing a monolithic inductor in accordance with the first preferred embodiment of the present invention, voids or cracks within the coil caused by the firing-shrinkage are eliminated. Even when a long coil is provided for molding inductors using multiple cavities, deflection of the coil can be prevented, due to the winding-core. Thus, preferred embodiments of the present invention provide a production method suitable for mass production.

While the invention has been particularly shown and described with reference to preferred embodiments thereof, it will be understood by those skilled in the art that the forgoing and other changes in form and details may be made therein without departing from the spirit of the invention.

What is claimed is:

1. A method of producing a chip inductor comprising the steps of:

inserting a conductive wire made of a metallic wire into a metallic mold;

supporting both end portions of the conductive wire on support portions provided on inner surfaces of the metallic mold so as to position the conductive wire in the approximate center portion of the metallic mold;

casting magnetic ceramic slurry into the metallic mold;

molding the ceramic slurry cast in the metallic mold by wet pressing to obtain a molding body having the conductive wire embedded therein;

firing the molding body; and forming external electrodes on both end surfaces of the fired magnetic core such that the external electrodes are connected to both end portions of the conductive wire; wherein the step of casting magnetic ceramic slurry into the metallic mold is performed after the step of supporting both end portions of the conductive wire.

2. The method of producing a chip inductor according to claim 1, wherein said conductive wire is a coil-shaped conductive wire made of a metallic wire defining a spiral shape.

3. The method of producing a chip inductor according to claim 1, further including the step of trimming both ends of the chip inductor to a desired length before the step of forming the external electrodes.

4. A method of producing a chip inductor comprising the steps of:

inserting a conductive wire made of a metallic wire into a metallic mold;

supporting both end portions of the conductive wire on support portions provided on inner surfaces of the metallic mold so as to position the conductive wire in the approximate center portion of the metallic mold;

casting magnetic ceramic slurry into the metallic mold;

molding the ceramic slurry cast in the metallic mold by wet pressing to obtain a molding body having the conductive wire embedded therein;

firing the molding body; and forming external electrodes on both end surfaces of the fired magnetic core such that the external electrodes are connected to both end portions of the conductive wire; wherein said molding step includes providing a filter which allows only water to pass through on said metallic mold, providing an upper die on the filter, and moving a lower die upward to press the ceramic slurry against the filter and upper die to extract water contained within the ceramic slurry.

5. The method of producing a chip inductor according to claim 4, wherein said upper die is provided with water-extracting holes.

6. A method of producing a chip inductor comprising the steps of:

inserting a conductive wire made of a metallic wire into a metallic mold;

supporting both end portions of the conductive wire on grooves provided in inner surfaces of the metallic mold so as to position the conductive wire in the approximate center portion of the metallic mold;

casting magnetic ceramic slurry into the metallic mold;

molding the ceramic slurry cast in the metallic mold by wet pressing to obtain a molding body having the conductive wire embedded therein;

firing the molding body; and forming external electrodes on both end surfaces of the fired magnetic core such that the external electrodes are connected to both end portions of the conductive wire.

* * * * *